US010041688B1

(12) United States Patent
Droppo

(10) Patent No.: US 10,041,688 B1
(45) Date of Patent: Aug. 7, 2018

(54) VENT PIPE COVER

(71) Applicant: Justin L. Droppo, St. Cloud, MN (US)

(72) Inventor: Justin L. Droppo, St. Cloud, MN (US)

( * ) Notice: Subject to any disclaimer, the term of this patent is extended or adjusted under 35 U.S.C. 154(b) by 451 days.

(21) Appl. No.: 14/063,443

(22) Filed: Oct. 25, 2013

(51) Int. Cl.
*F24D 19/08* (2006.01)

(52) U.S. Cl.
CPC ..... *F24D 19/08* (2013.01)

(58) Field of Classification Search
CPC .. F24D 19/08; F24D 19/083; F24F 2007/003; F24F 13/082; F24F 13/084; F24F 13/085
USPC ..... 454/146, 147, 275, 276, 283, 367, 370, 454/358
See application file for complete search history.

(56) References Cited

U.S. PATENT DOCUMENTS 3,797,181 A * 3/1974 Nievelt ..... E04F 17/04 285/43
3,881,752 A * 5/1975 Fujishima ..... F16L 5/10 174/151
4,768,812 A 9/1988 Katz
4,897,974 A 2/1990 Lane
4,903,997 A 2/1990 Kifer
5,010,700 A 4/1991 Blair
5,226,263 A * 7/1993 Merrin ..... E04D 13/1476 285/42
5,303,522 A * 4/1994 Vagedes ..... F24F 13/08 52/209
5,394,663 A 3/1995 Jackson
5,472,241 A 12/1995 Kosik, Jr.
5,482,507 A * 1/1996 Priest ..... F24F 13/075 34/235
5,694,724 A 12/1997 Santiago
5,722,181 A * 3/1998 Meyer ..... D06F 58/20 34/235
5,860,256 A 1/1999 Humber
5,946,863 A 9/1999 Bullard
5,947,816 A * 9/1999 Schiedegger ..... F24F 7/02 454/241
6,279,272 B1 8/2001 Nill, Jr.
6,601,351 B1 * 8/2003 Zerfoss ..... E04D 13/1407 285/42
7,882,670 B2 2/2011 West
8,272,186 B2 9/2012 Manning
8,453,389 B2 6/2013 Selke
8,490,351 B1 7/2013 Scott
2005/0150176 A1 * 7/2005 Erekson ..... E04D 13/1476 52/58
2006/0243268 A1 * 11/2006 Jacklich ..... F23L 17/04 126/85 B
2008/0157518 A1 7/2008 Cecilio
2012/0228863 A1 9/2012 Coleman

* cited by examiner

*Primary Examiner* — Gregory Huson
*Assistant Examiner* — Dana Tighe
(74) *Attorney, Agent, or Firm* — Neustel Law Offices

(57) ABSTRACT

A vent pipe cover for providing a water tight flashing seal around pipes penetrating from the exterior wall of a structure. The vent pipe cover generally includes a sealing unit adapted to be secured around vent pipe extending from a building. The sealing unit includes a central gasket which seals the gap between the pipe and the building and an outer flange adapted to receiver fasteners for securing the sealing unit to the building. A trim unit is also included which may be slidably connected to the sealing unit to cover the outer flange and provide a finished look.

11 Claims, 10 Drawing Sheets

VENT PIPE COVER

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

Field of the Invention

The present invention relates generally to a pipe cover and more specifically it relates to a vent pipe cover for providing a water tight flashing seal around pipes penetrating from the exterior wall of a structure.

Description of the Related Art

Any discussion of the related art throughout the specification should in no way be considered as an admission that such related art is widely known or forms part of common general knowledge in the field.

There is an increasing usage of high efficiency furnaces, boilers, and water heaters due to changes in building codes as well as a growing desire on the part of builders and consumers to save energy costs. These high efficiency units tend to be vented through a wall rather than up through a roof as is typical of less efficient models. It is important that the area around the vent pipes extending through a wall be properly sealed to prevent water incursion, which can lead to mold, rot, and other costly situations.

In the past, modified mounts have been provided for flashing the area around a pipe extruding through a wall. However, these modified mounts have not in the past included a central gasket and thus have required a hole to be specifically sized and cut to fit around the pipe. This leads to a longer and more complicated install-time, and increases the risk of error.

Because of the inherent problems with the related art, there is a need for a new and improved vent pipe cover for providing a water tight flashing seal around pipes penetrating from the exterior wall of a structure.

BRIEF SUMMARY OF THE INVENTION

The invention generally relates to a pipe cover which includes a sealing unit adapted to be secured around vent pipe extending from a building. The sealing unit includes a central gasket which seals the gap between the pipe and the building and an outer flange adapted to receiver fasteners for securing the sealing unit to the building. A trim unit is also included which may be slidably connected to the sealing unit to cover the outer flange and provide a finished look.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
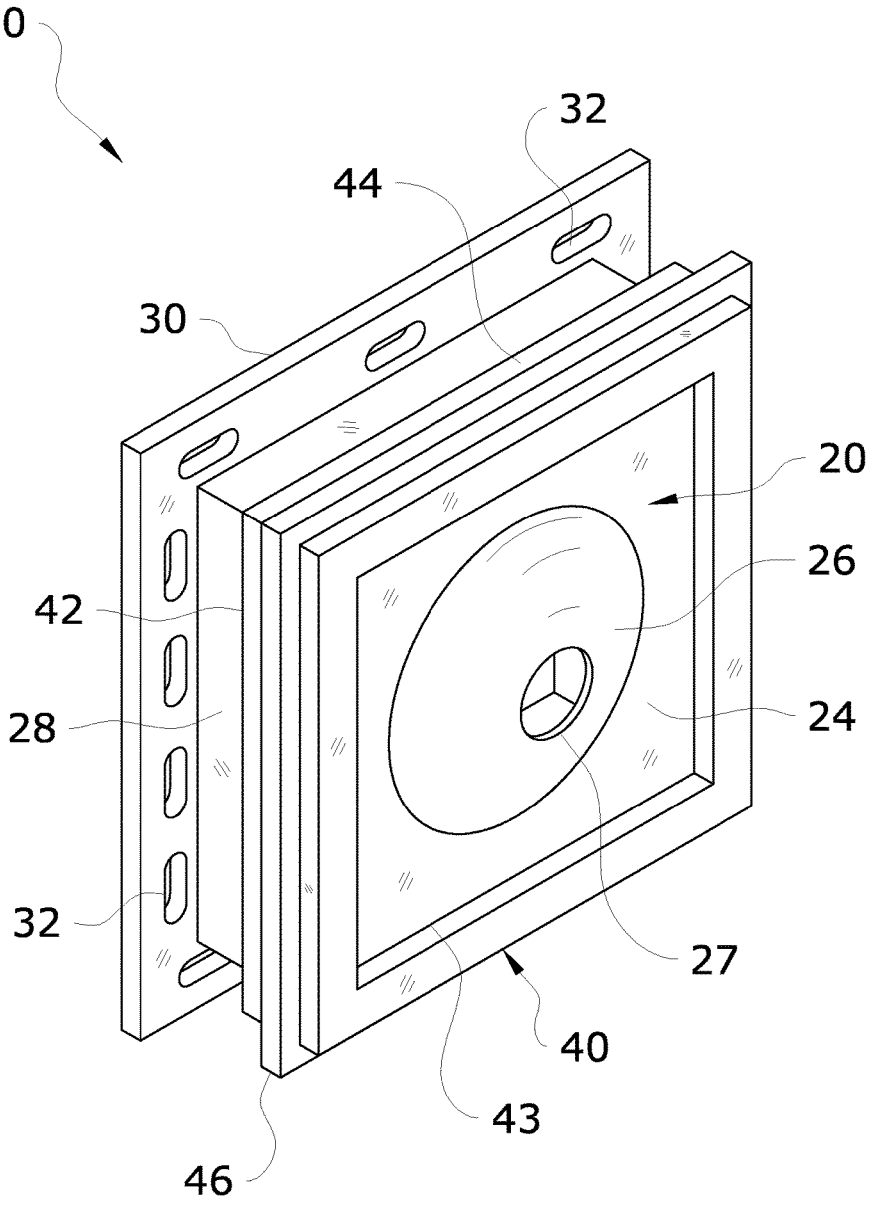
FIG. 1 is a front upper perspective view of the present invention.

A. Overview.

Turning now descriptively to the drawings, in which similar reference characters denote similar elements throughout the several views, FIGS. 1 through 10 illustrate a vent pipe cover 10, which comprises a sealing unit 20 adapted to be secured around vent pipe 12 extending from a building 11. The sealing unit 20 includes a central gasket 26 which seals the gap between the pipe 12 and the building 11 and an outer flange 30 adapted to receiver fasteners 34 for securing the sealing unit 20 to the building 11. A trim unit 40 is also included which may be slidably connected to the sealing unit 20 to cover the outer flange 30 and provide a finished look.

B. Sealing Unit.

Figure 4:
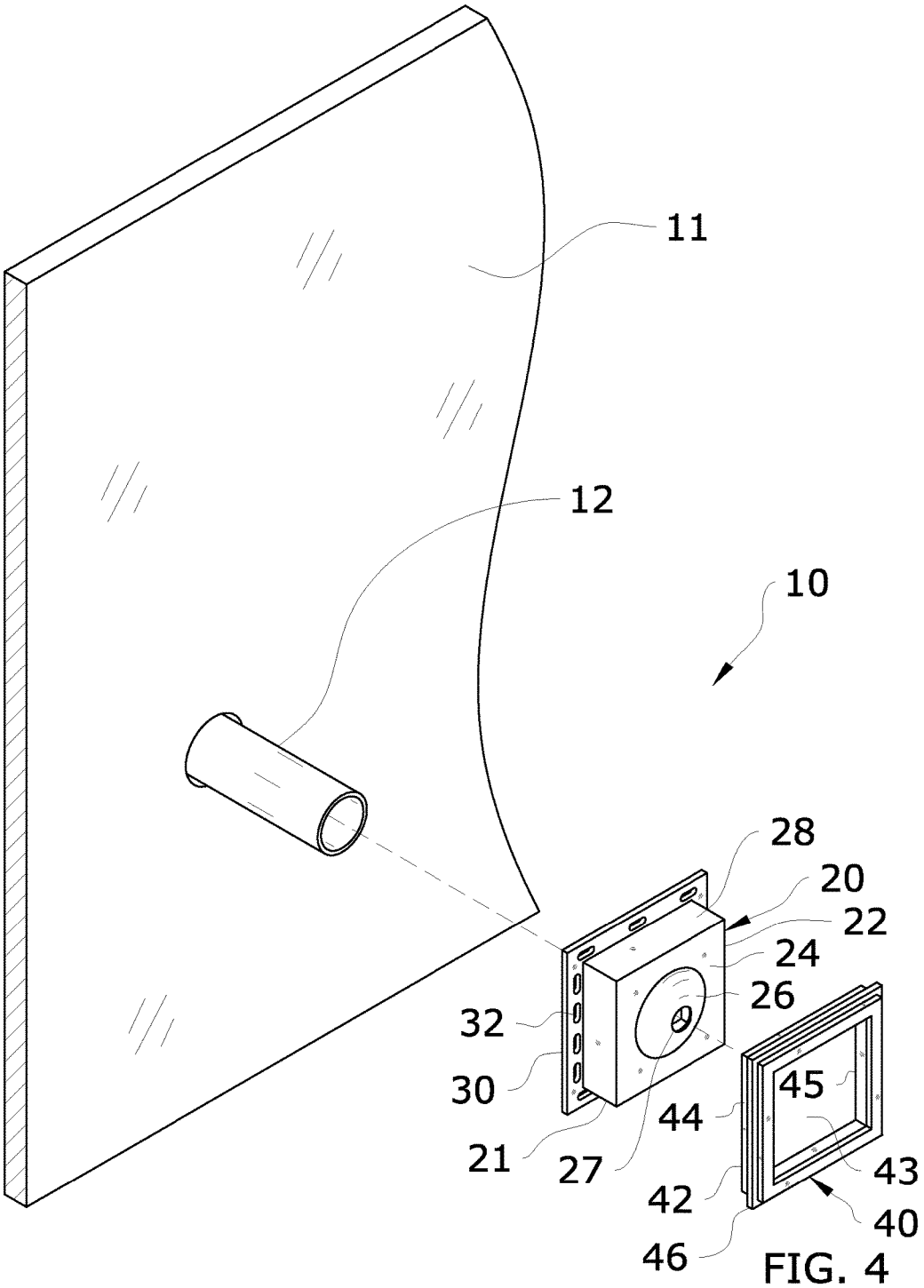
FIG. 4 is a front upper perspective view of the present invention being aligned with a pipe extending from the exterior of a building.
Figure 5:
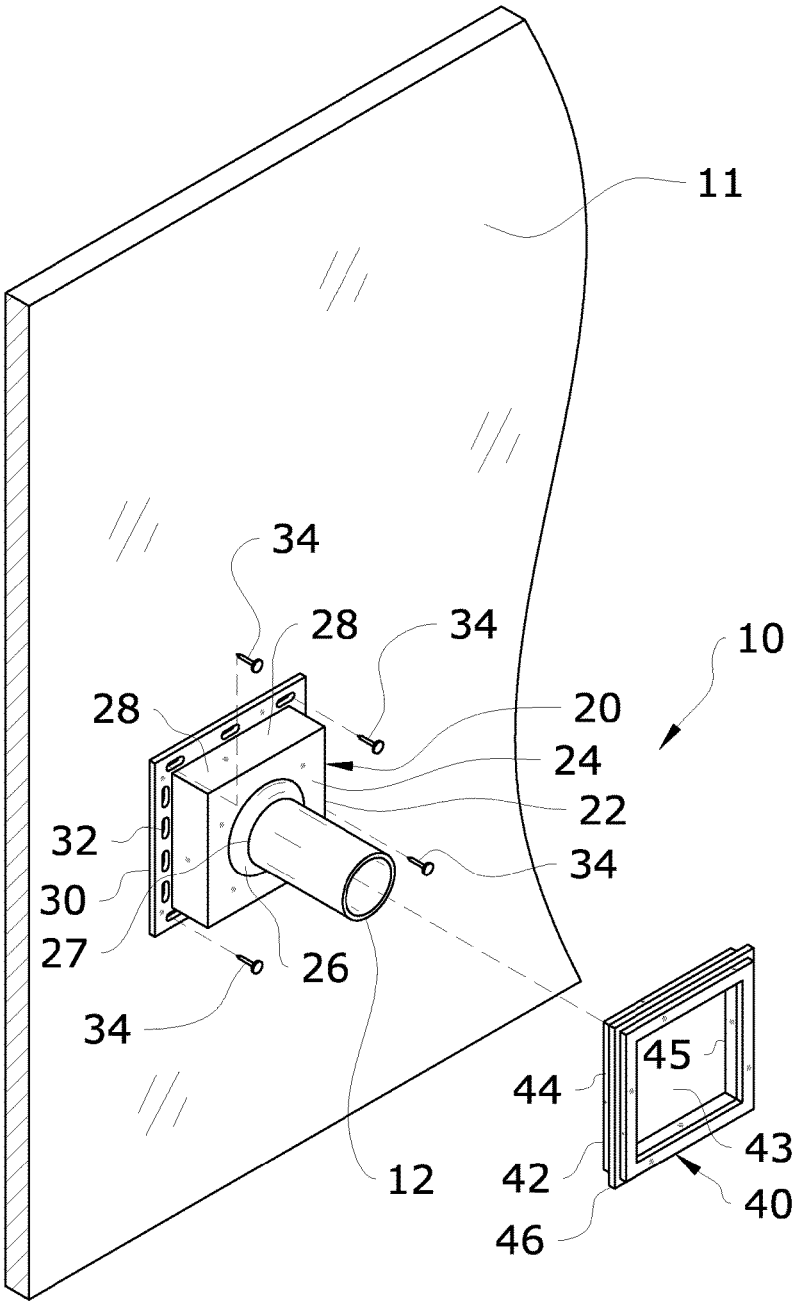
FIG. 5 is a front upper perspective view of the sealing unit being secured around a pipe.
Figure 6:
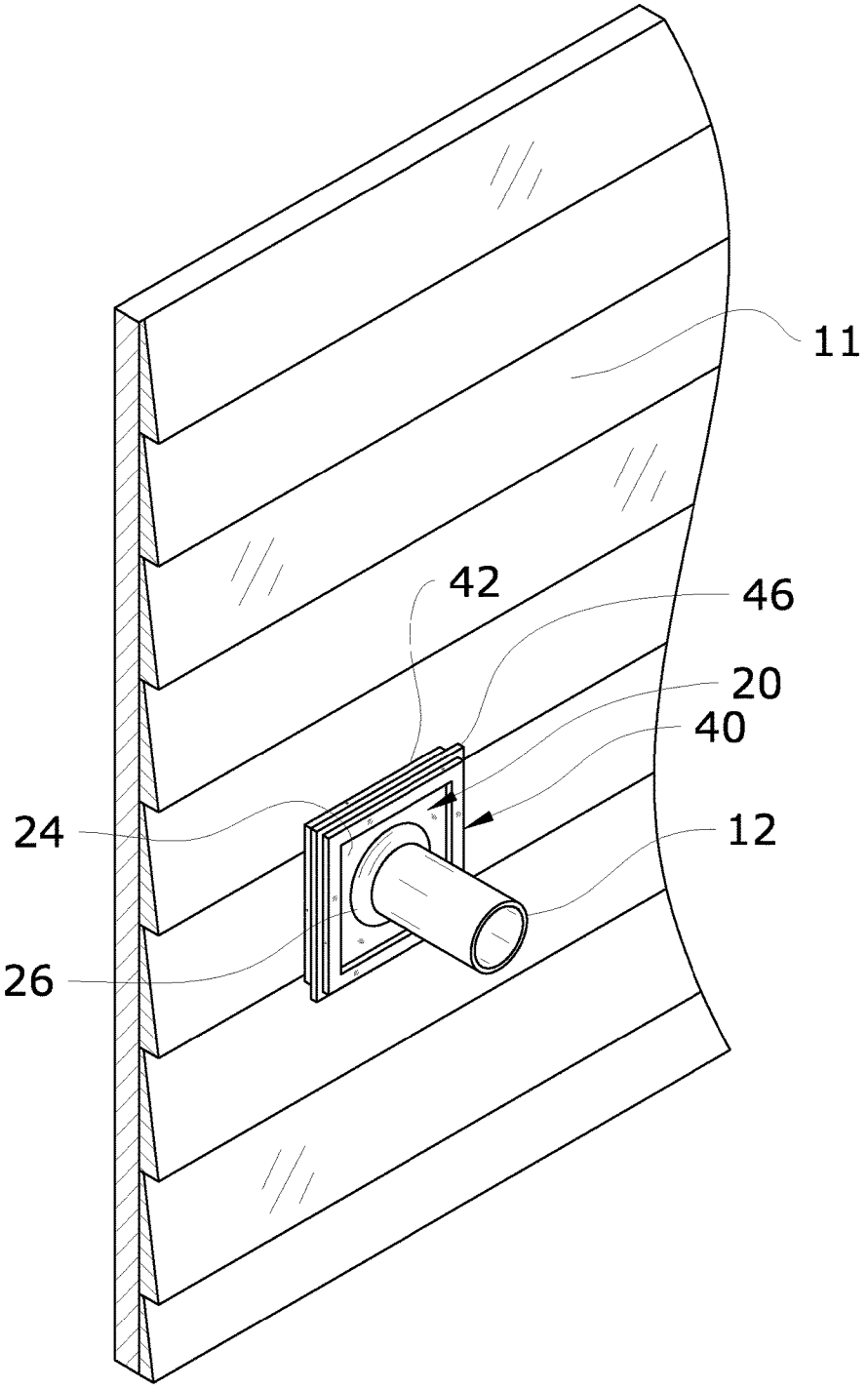
FIG. 6 is a front upper perspective view of the present invention in use.

As best shown in FIGS. 4 and 5, the present invention includes a sealing unit 20 which is adapted to be secured around a pipe 12 extending from the exterior of a building 11 to seal the gap between the external circumference of the pipe 12 and the building 11 itself. The sealing unit 20 may be comprised of various shapes and sizes to accommodate different types of piping 12, and thus the exemplary figures should not be construed as limiting the scope of the present invention as it relates to the shape, size, and configuration of the sealing unit 20.

Figure 2:
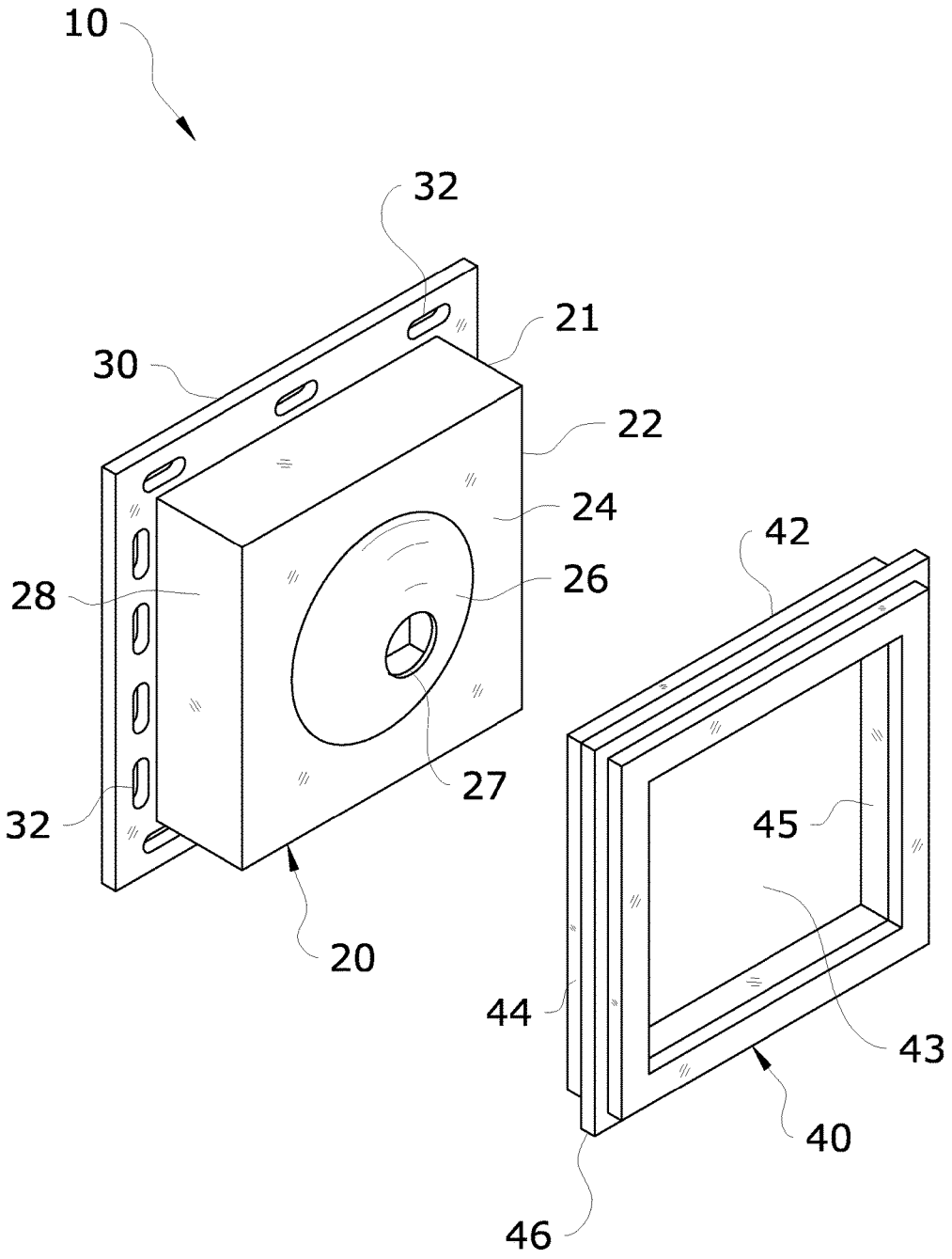
FIG. 2 is a front upper perspective view of the present invention with the trim unit separated from the sealing unit.
Figure 3:
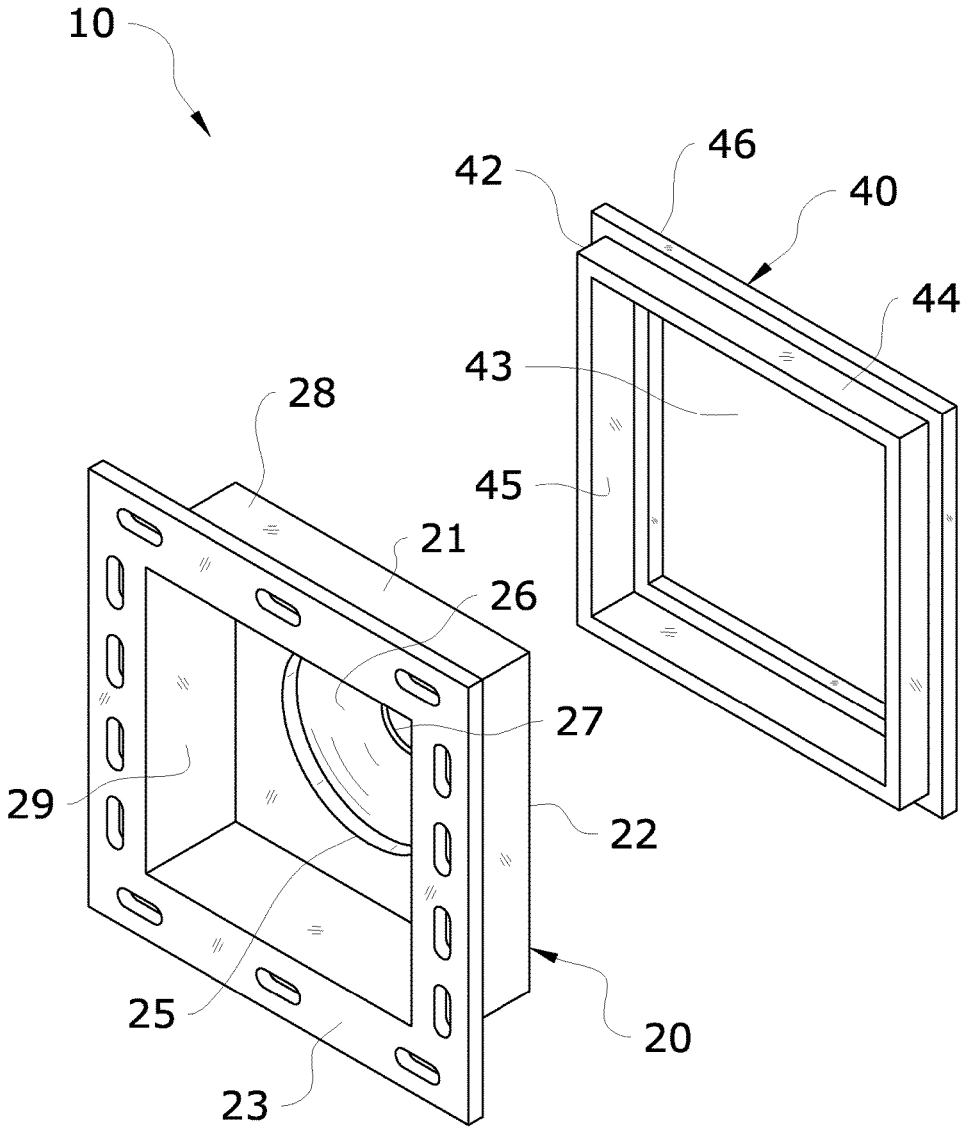
FIG. 3 is a rear upper perspective view of the present invention with the trim unit separated from the sealing unit.

In a preferred embodiment as best shown in FIGS. 2 and 3, the sealing unit 20 comprises a tubular frame 21 having an outer end 22 which faces away from the building 11 and an inner end 23 which faces the building 11 when the sealing unit 20 is installed. The tubular frame 21 includes an outer surface 28 which faces away from the pipe 12 when installed and an inner surface 27 which faces toward the pipe 12 when installed.

In a preferred embodiment as shown, the tubular frame 21 will include a square cross sectional area, though other cross sectional areas may be utilized. The depth of the tubular frame 21 (width between the outer end 22 and inner end 23) may also vary depending on the application.

The outer end 22 of the tubular frame 21 of the sealing unit 20 includes an outer cover 24 which, in some embodiments, may be integrally formed with the tubular frame 21 as best shown in FIG. 2. The outer cover 24 includes a central opening 25 in which a gasket 26 is positioned. The gasket 26 will be utilized to seal the gap between the building 11 and the pipe 12.

As shown throughout the figures, a conventional gasket 26 may be utilized within the central opening 25 of the outer cover 20 to seal the area around the pipe 12. The gasket 26 will preferably be comprised of an elastic, waterproof material such as rubber. The central portion of the gasket 26 includes a gasket opening 27 through which the pipe 12 will extend when the sealing unit 20 is installed as shown in FIG. 5.

C. Nailing Flange.

As best shown in FIGS. 1-5, a flange 30 extends outwardly from the outer surface 28 of the tubular frame 21 of the sealing unit 20. The flange 30 is utilized to secure the sealing unit 20 to the building 11 as shown in FIGS. 4-5. The flange 30 may be secured to the building 11 with various structures or methods, but will preferably include a plurality of fastener receivers 32 comprised of slots or openings adapted to receive fasteners 34. The fasteners 34 act to secure the sealing unit 20 to the building 11.

D. Trim Unit.

As best shown in FIGS. 1-5, the present invention includes a trim unit 40 which is slidably connected to the sealing unit 20. The trim unit 40 is preferably comprised of a square structure similar in shape and size to the flange 30 that slides upon the tubular frame 21 to be removably retained thereon. The trim unit 40 may be removably connected to the sealing unit 20 through various methods, such as through usage of clips molded onto both units or through frictional engagement.

Figure 7:
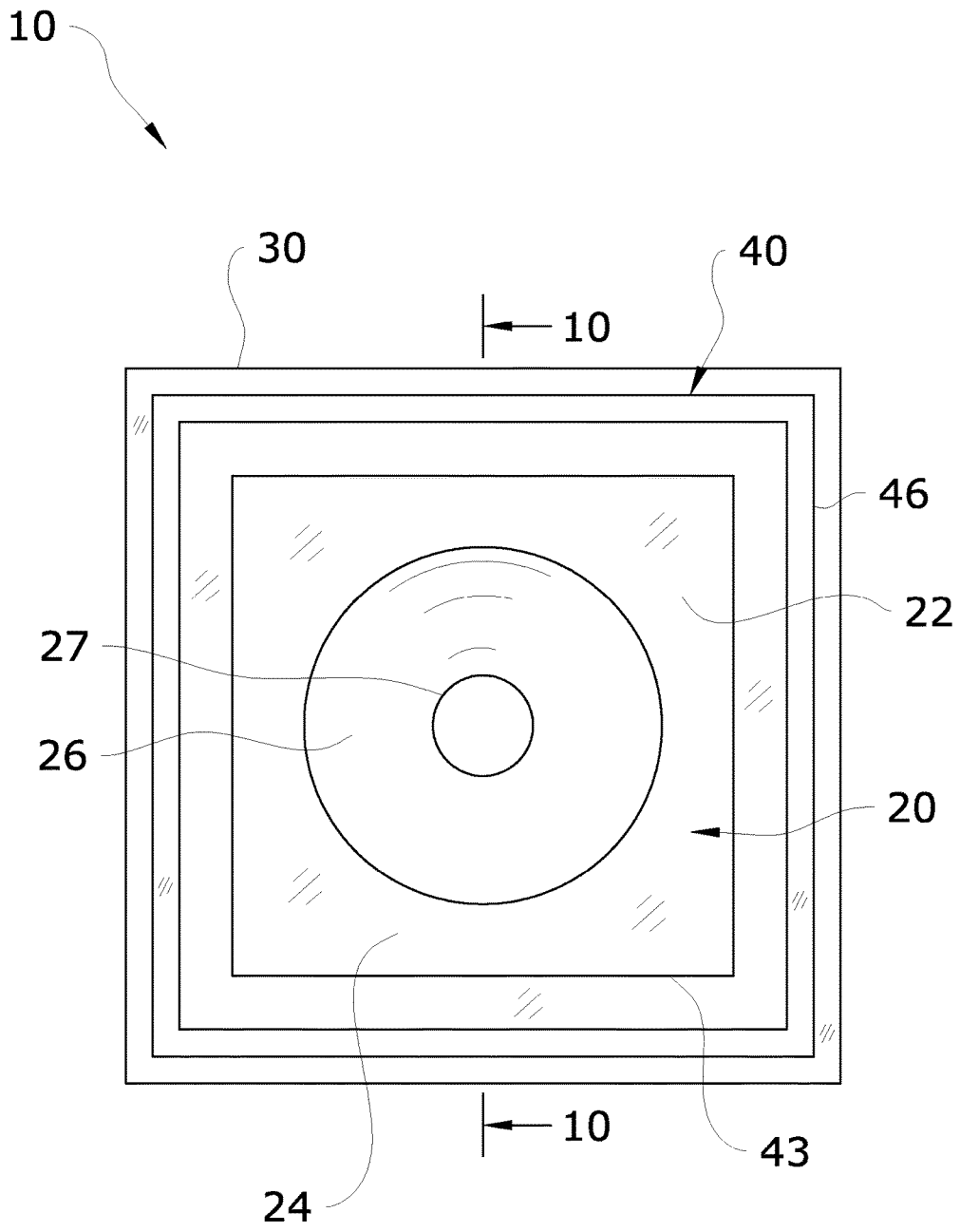
FIG. 7 is a frontal view of the present invention.
Figure 8:
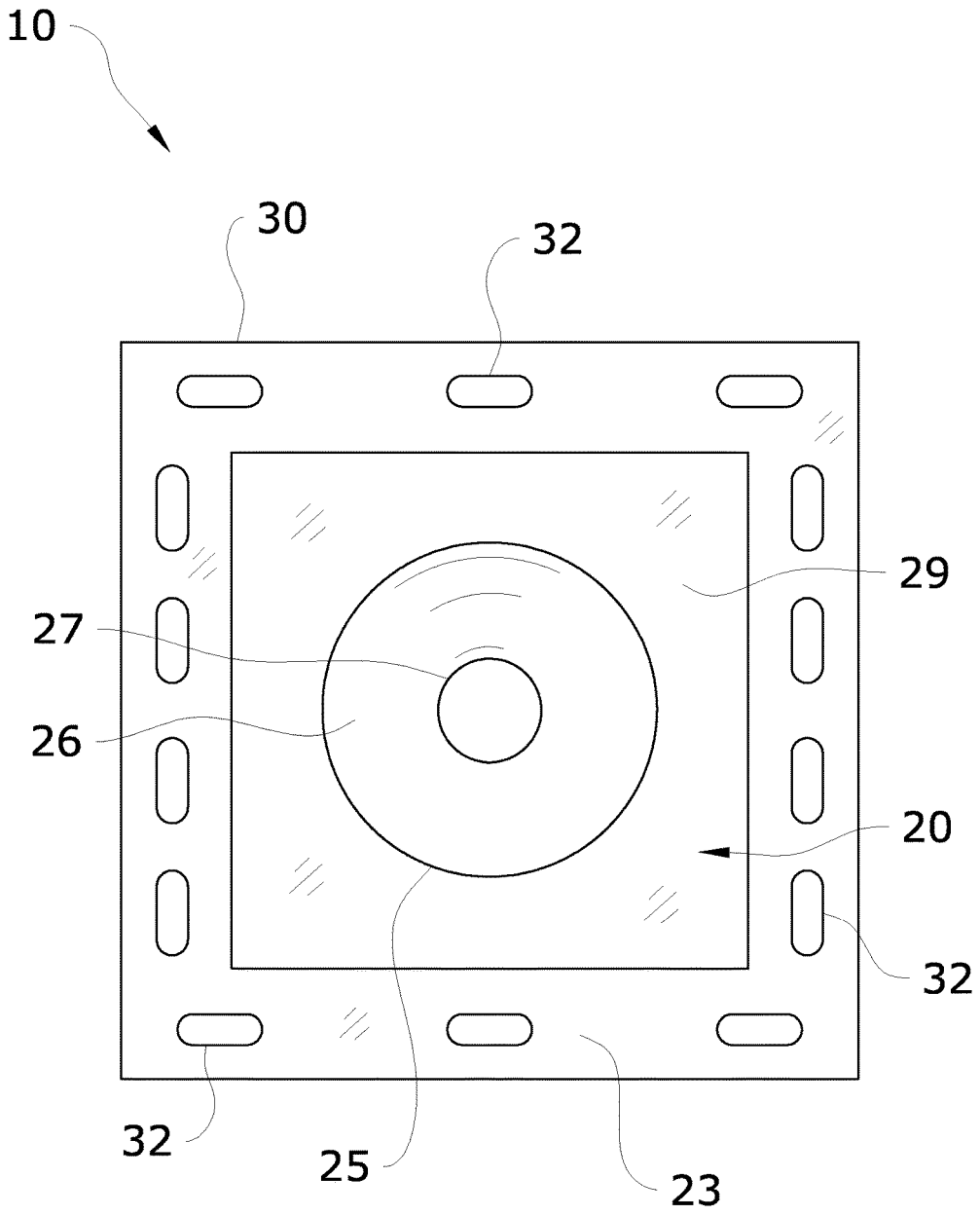
FIG. 8 is a rear view of the present invention.
Figure 9:
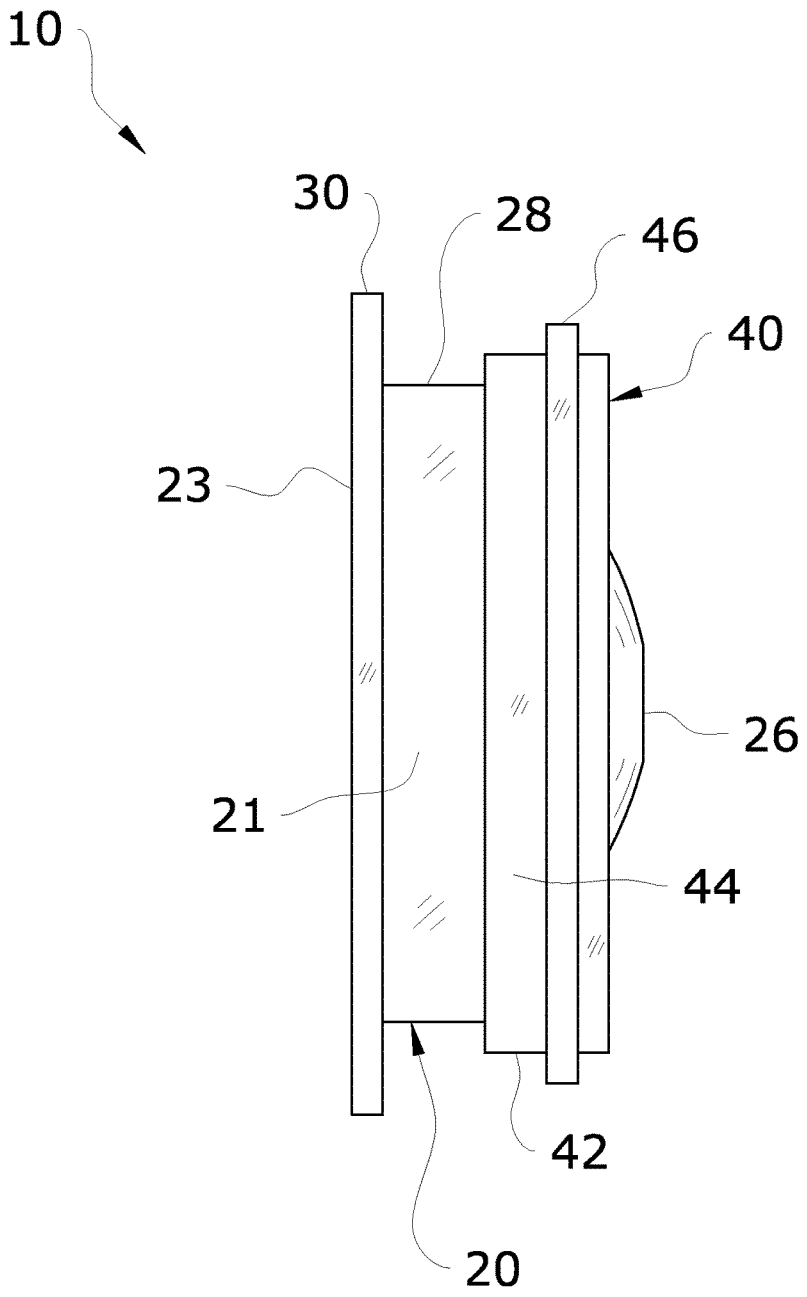
FIG. 9 is a side view of the present invention.
Figure 10:
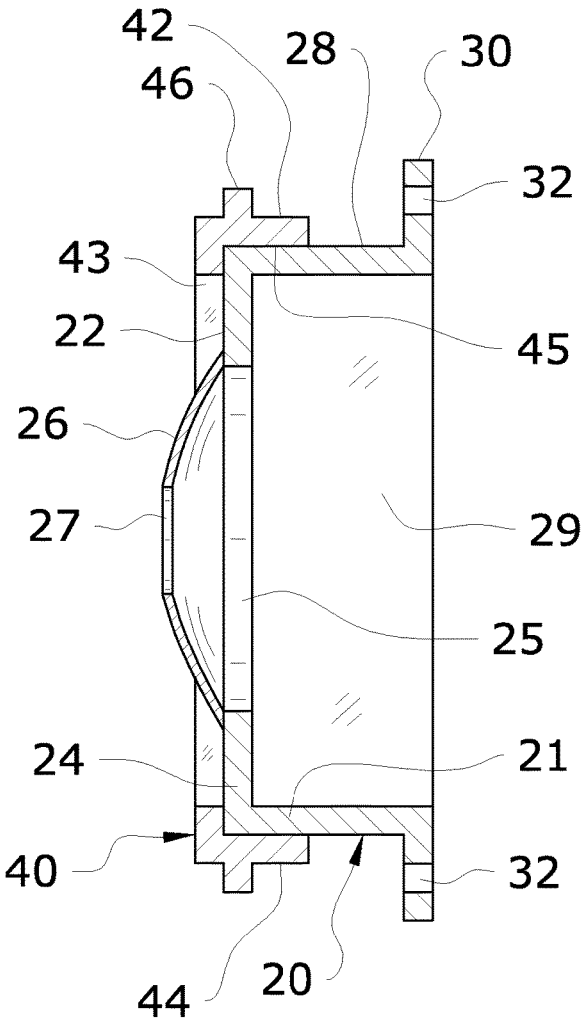
FIG. 10 is a side sectional view of the present invention.

In a preferred embodiment as shown in the figures, the trim unit 40 comprises an outer frame 42 which includes an outer surface 44 and an inner surface 45. A central opening 43 extends through the center of the outer frame 42 in which the tubular frame 21 of the sealing unit 20 will be secured as shown in FIGS. 1, 7, and 9.

The dimensions of the opening 43 of the outer frame 42 will preferably be equal to or just slightly greater than the dimensions of the tubular frame 21 so as to effectuate a tight connection between the trim unit 40 and the sealing unit 20. The dimensions of the outer frame 42 as a whole will preferably be equal to or greater than those of the flange 30 so that the trim unit 40 covers the flange 30. This protects the fasteners 34 from rust and provides a more aesthetic appeal.

When connected to the sealing unit 20 as illustrated in FIGS. 1, 6, 8, 9, and 10, the inner surface 45 of the trim unit 40 will abut against the outer surface 28 of the tubular frame 21. The trim unit 40 may include a rim portion 46 extending outwardly from the outer surface 44 of the outer frame 42 and/or inwardly from the inner surface 45 of the outer frame 42 as shown in FIG. 3. An outwardly-extending rim portion 46 aids with connecting and disconnecting the trim unit 40 to/from the sealing unit 20. An inwardly-extending rim portion 46 acts as a stopper to prevent further advancement of the tubular frame 21 of the sealing unit 20 within the central opening 43 of the outer frame 42 of the trim unit 40.

E. Operation of Preferred Embodiment.

In use, the sealing unit 20 is first positioned around the pipe 12 as shown in FIG. 5. The sealing unit 20 is positioned such that the pipe 12 extends through the gasket opening 27. The gasket 26 then acts to sealably cover any gap between the pipe 12 and the building 11. The sealing unit 20 is secured to the building 11 around the pipe 12 by inserted fasteners 34 such as nails through the fastener receivers 32 as is illustrated in FIG. 5.

The present invention may act as a channel for siding to be placed into if needed. After securing the sealing unit 20 around the pipe 12 and to the building 11, siding may be positioned over the flange 30. The trim unit 40 may then be connected to the sealing unit 20, acting to sandwich the siding between the trim unit 40 and sealing unit 20. The trim unit 40 will preferably snap onto the sealing unit 20 in a manner which allows for removal at a later time. The trim unit 40 will protect the flange 30 as well as provide an aesthetic appeal to offer a finished look.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A vent pipe cover system, comprising:

a pipe;

a sealing unit adapted to be secured around said pipe, wherein said sealing unit comprises a tubular frame and a raised outer cover extending outwardly from said tubular frame, wherein said outer cover includes a central opening including a central gasket, wherein said central gasket comprises a concave shape when not secured around said pipe;

a flange extending around said tubular frame, wherein said flange includes a plurality of openings adapted to receive fasteners; and a trim unit removably and slidably connected to said sealing unit, wherein said trim unit comprises an outer frame and an internal opening, wherein the outer cover of the sealing unit extends through the internal opening to frictionally engage with the outer frame of the trim unit, wherein said pipe is adapted to extend through both said sealing unit and said trim unit, wherein an exterior end of said pipe is uncovered and exposed to an exterior atmosphere.

2. The vent pipe cover system of claim 1, wherein said sealing unit is comprised of a square cross sectional area.

3. The vent pipe cover system of claim 1, wherein said trim unit is comprised of a square structure adapted to slide upon said tubular frame.

4. The vent pipe cover system of claim 1, wherein said central gasket is comprised of rubber.

5. The vent pipe cover system of claim 1, wherein said pipe extends horizontally through said sealing unit and said trim unit in an orientation parallel with a ground surface.

6. A vent pipe cover system, comprising:

a pipe;

a sealing unit adapted to be secured around said pipe, wherein said sealing unit comprises a tubular frame and a raised outer cover extending outwardly from said tubular frame, wherein said outer cover includes a central opening including a central gasket;

a flange extending around said tubular frame, wherein said flange includes a plurality of openings adapted to receive fasteners, wherein said flange includes an inner end which is secured against a wall and an outer end from which said raised outer cover extends; and a trim unit removably and slidably connected to said sealing unit, wherein said trim unit comprises an outer frame and an internal opening, wherein the outer cover of the sealing unit extends through the internal opening to frictionally engage with the outer frame of the trim unit, wherein said pipe is adapted to extend through both said sealing unit and said trim unit, wherein said pipe is exposed to an exterior atmosphere, wherein said pipe extends horizontally through said sealing unit and said trim unit in an orientation parallel with a ground surface, wherein an exterior end of said pipe is uncovered.

7. The vent pipe cover system of claim 6, wherein said central gasket is comprised of rubber.

8. A method for sealing a vent pipe penetrating from an exterior wall of a structure, comprising:

providing a sealing unit, wherein said sealing unit comprises a tubular frame and a raised outer cover extending outwardly from said tubular frame, wherein said outer cover includes a central opening including a central gasket, wherein said sealing unit includes a flange extending around said tubular frame, wherein said flange includes a plurality of openings adapted to receive fasteners, wherein said flange includes an inner end which is secured against the exterior wall and an outer end from which said raised outer cover extends, wherein said central gasket comprises a concave shape when not secured around said vent pipe;

positioning said sealing unit around said vent pipe such that said vent pipe extends through said central gasket and said sealing unit, wherein an exterior end of said vent pipe is uncovered;

securing said flange to said exterior wall of said structure; and connecting a trim unit to said sealing unit such that said trim unit covers said flange, wherein said vent pipe extends through said trim unit, wherein said trim unit comprises an outer frame and an internal opening, wherein the outer cover of the sealing unit extends through the internal opening to frictionally engage with the outer frame of the trim unit, wherein said vent pipe is exposed to an exterior atmosphere, wherein said vent pipe extends horizontally through said sealing unit and said trim unit in an orientation parallel with a ground surface.

9. The method of claim 8, wherein said central gasket is comprised of rubber.

10. The method of claim 8, wherein said sealing unit is comprised of a square cross sectional area.

11. The method of claim 8, further comprising the step of securing a siding between said sealing unit and said trim unit.

* * * * *